US005769737A

United States Patent [19]

Holladay et al.

[11] Patent Number: 5,769,737

[45] Date of Patent: Jun. 23, 1998

[54] ADJUSTABLE WEIGHT GOLF CLUB HEAD

[76] Inventors: Brice R. Holladay, 741 Old Hickory Rd., Jacksonville, Fla. 32207; Richard B. Hendrickson, 8335 Freedon Crossing Trail #4201, Jacksonville, Fla. 32256

[21] Appl. No.: 824,811

[22] Filed: Mar. 26, 1997

[51] Int. Cl.[6] ..... A63B 53/06

[52] U.S. Cl. ..... 473/336; 473/340

[58] Field of Search ..... 473/334, 335, 473/336, 337, 340, 338, 339, 256, 291

[56] References Cited

U.S. PATENT DOCUMENTS

| | | | |
|---|---|---|---|
| 3,220,733 | 11/1965 | Saleeby | 473/333 |
| 3,606,327 | 9/1971 | Gorman | 473/337 |
| 3,749,408 | 7/1973 | Mills | 473/336 |
| 4,121,832 | 10/1978 | Ebbing | 473/335 |
| 4,962,932 | 10/1990 | Anderson | 473/336 |
| 5,230,509 | 7/1993 | Chavez | 473/334 |
| 5,244,210 | 9/1993 | Au | 473/336 |
| 5,571,053 | 11/1996 | Lane | 473/336 |

*Primary Examiner*—Sebastiano Passaniti
*Attorney, Agent, or Firm*—Thomas C. Saitta

[57] ABSTRACT

A golf club head, and particularly a putter head, having a generally horizontally disposed weight receiving cavity which extends longitudinally and laterally within the club head, and one or more weight members having weight securing means to releasably attach the weight members within the weight receiving cavity at any position laterally or longitudinally within the weight receiving cavity.

6 Claims, 2 Drawing Sheets

ADJUSTABLE WEIGHT GOLF CLUB HEAD

This invention relates generally to golf clubs and more particularly to golf club heads which are adjustable as to the total club head weight, the number of weight members and the position of individual weight members. Even more particularly, the invention relates to such golf club heads, particularly putters, where the weights are positionable at any point within a weight retaining cavity both longitudinally from heel to toe and laterally from face to back.

Golf club design is extremely important for maximizing golf club performance. Golf clubs from drivers to irons to putters are available in a multitude of designs and constructions, each attempting to maximize one or more desirable club characteristics—control, distance, feel, etc. On the one hand, the skill level of the golfer sometimes dictates whether a given club performs to its ability. On the other hand, a technically superior golf club can often improve any golfer's level of play. For any golfer, the ability to alter the weight and balance of a club head allows the club to be customized to match the skills and preferences of the individual. Highly skilled golfers such as professionals are very cognizant of the feel of a golf club and, because of the precision of their golfing ability, minute adjustments in the weight and balance of a club head can significantly improve results.

There have been many attempts to design golf club heads which allow the weight and balance to be adjusted. For example, U.S. Pat. No. 645,942 to Cran shows a golf club head having a longitudinal bore open at the toe of the club and containing a cylindrical weight fixed in place by a set screw accessed through a slot in the rear of the club head. U.S. Pat. No. 3,220,733 to Saleeby shows a putter having a keyed channel cut into the rear wall which allows a weight to be longitudinally interlocked with the channel, the weight itself forming the rear of the club head. In U.S. Pat. No. 3,749,408 to Mills, a golf putter is shown which contains a rearward facing cavity. An adhesively backed lead tape is placed into the cavity and the cavity closed. The weight, size or position of the tape can be varied to alter the club head. U.S. Pat. No. 5,429,356 to Dingle et al. shows a putter with three rearward facing threaded members. Various washer weights are secured onto the posts to alter the balance and weight of the club head. In U.S. Pat. No. 5,489,097 to Simmons, a putter is shown having a forward longitudinal bore, toe end lateral bore and a heel end lateral bore, each designed to receive a cylindrical weight. U.S. Pat. No. 5,571,053 to Lane shows a cantilevered-weighted putter having a toe end longitudinal bore and a front end longitudinal bore, each of which receives a combination of tubular weights. All of these patents address the desire to produce a golf club head with adjustable weight and balance, however each is limited by the manner in which the weights are positioned within the club heads. The Saleeby design allows the amount of weight to be adjusted, but the positioning of the weight is fixed. Cran, Mills and Lane provide a design where the weight can be adjusted longitudinally heel to toe only. Simmons and Dingle et al. provide means where the weight and balance can be adjusted longitudinally and laterally, but at fixed locations only.

It is an object of this invention to provide a golf club head, and in particular a golf club putter head, which is adjustable as to total weight and balance. It is a further object to provide such a club head where the adjustability is accomplished in a relatively simple manner, where single weight members or multiple weight members of varying size, shape and weight can be used either connected or separately, and where the single or multiple weights are positionable at any point laterally or longitudinally within a weight receiving cavity which extends relatively horizontally a majority of the distance from heel to toe and from the interior of the face completely through the rear wall, thereby allowing the club head to be adjusted for total weight and balance in an infinite number of ways.

SUMMARY OF THE INVENTION

The invention is a golf club head, and particularly a golf club putter head, comprising in general a striking or forward face, a rear wall, a toe end, a heel end, a top surface and a sole or bottom surface, the club head being attached in conventional manner to a golf club shaft by a hosel. The club head contains a generally horizontally disposed weight receiving cavity open through the rear wall of the club head and extending longitudinally the majority of the distance from the toe end to the heel end and laterally through the body of the club head toward the striking face. The weight receiving cavity has generally parallel, generally planar upper and lower surfaces, a toe wall, a heel wall and a front wall, which together define the extent and shape of the weight receiving cavity. In this manner a significant portion of the interior of the club head is composed of the weight receiving cavity. Preferably, a portion of the club head top surface and rear wall is removed to create a surface cavity which reduces the overall weight of the club head while providing sufficient structure for the striking surface.

Single or multiple weight members, each comprising a one-piece body or a multi-part body of two or more connected weight sections, are provided which are insertable into the weight receiving cavity. Securing means are provided to fix the weight or weight members at particular locations within the weight receiving cavity. The securing means prevent movement of the weight members when the club head is in use, but allow the weight members to be released and repositioned at any different position within the weight receiving cavity as desired to alter the balance of the club head. The weight members, whether one-piece or multi-part, may be provided in any individual weight amount or shape as desired. With multi-part weight members, each weight section may be of different weight and shape.

In a preferred embodiment, the weight member is a multi-part weight having a first or outer weight section and a second or inner weight section, generally rectangular in configuration, each containing a laterally extending bore where the bore in the inner weight section is threaded to receive a locking bolt extending through the non-threaded bore in the outer section. One, and preferably both, of the contact walls of the weight sections is bevelled such that the two contact walls are not parallel. In this manner, when the locking bolt is tightened the inner member is drawn against the outer member and the non-parallel contact walls cause the weight sections to misalign, wedging the weight member against the upper and lower surfaces of the weight cavity.

DETAILED DESCRIPTION OF THE INVENTION

Figure 1:
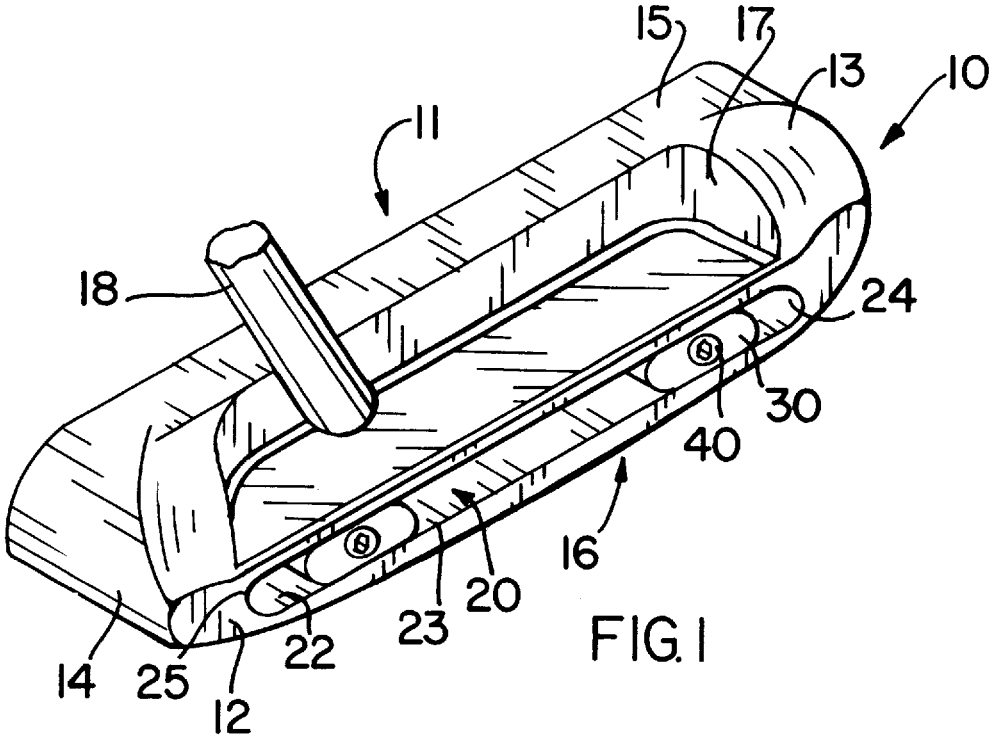
FIG. 1 is a perspective view of the invention, showing an embodiment with two weight members.

With reference to the drawings, the invention will now be described with regard for the best mode and preferred embodiment. The invention comprises in general a golf club head with at least one adjustable weight member, and the club head is preferably a golf club putter head, as shown in the drawings. However it is to be understood that the invention may also comprise golf clubs known as wedges, irons, woods or drivers, as well as different putter head designs, such as other modified blades or mallets.

Figure 2:
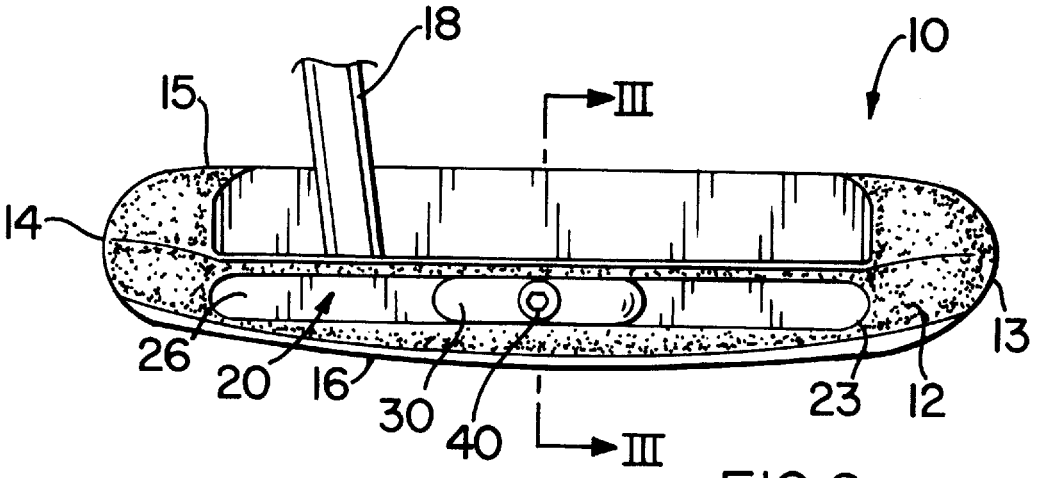
FIG. 2 is a rear view of the invention showing an embodiment with one weight member.
Figure 3:
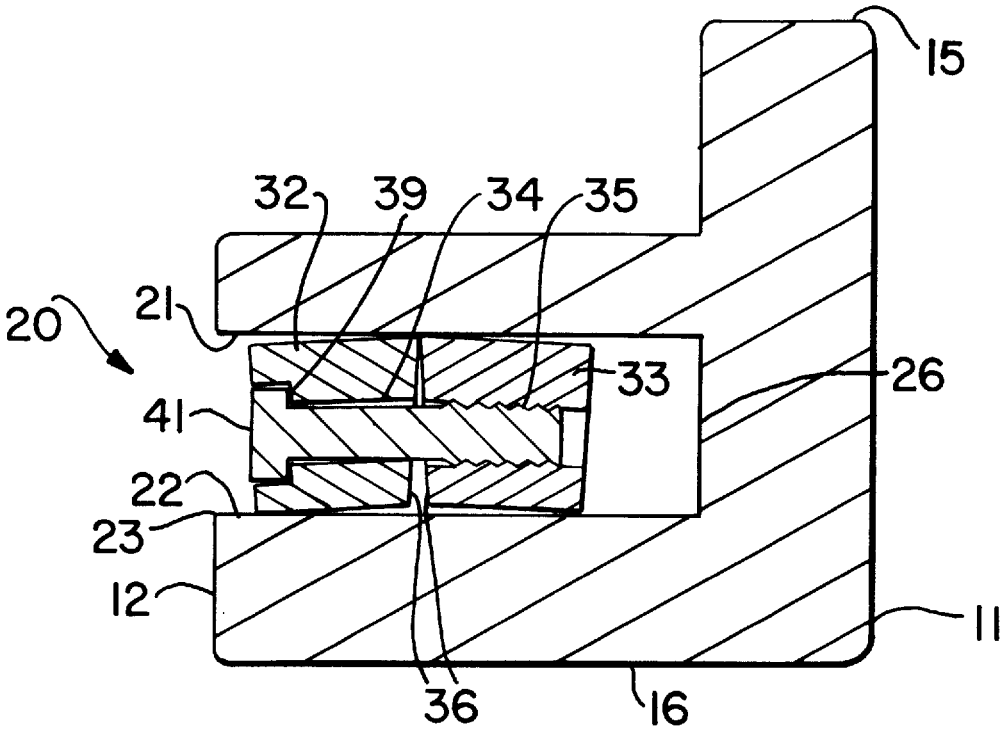
FIG. 3 is a cross-sectional view taken along line III—III of FIG. 2.

As seen generally in FIGS. 1 and 2, the invention is a golf club head 10 which in use is connected in conventional manner to a golf club shaft (not shown) by a hosel 18. The club head 10 comprises a striking or forward face 11, a rear wall 12, a toe end 13, a heel end 14, a top surface 15 and a sole or bottom surface 16. Disposed within the club head 10 is a generally horizontally oriented weight receiving cavity 20. Weight receiving cavity 20 is defined by an upper surface 21, a lower surface 22, a toe wall 24, a heel wall 25 and a front wall 26. The weight receiving cavity 20 opens through the club head rear wall 12 such that access to the interior of the weight receiving cavity is through a slot-like access opening 23. The cavity upper surface 21 and cavity lower surface 22 are preferably generally planar and are parallel to each other. Front wall 26, toe wall 24 and heel wall 25 may be planar or curved. Weight receiving cavity 20 is preferably positioned in the lower half of club head 10 and is preferably generally rectangular in configuration, having an elongated longitudinal dimension in the direction between toe wall 24 and heel wall 25, a lesser extended lateral dimension in the direction between front wall 26 and access opening 23, and a relatively short vertical dimension in the direction between the upper surface 21 and the lower surface 22. Preferably the weight receiving cavity 20 extends the majority of the longitudinal distance between the club head toe end 13 and club head heel end 14 to maximize the range of possible longitudinal positions for the weight member or members 30. The weight receiving cavity 20 extends laterally toward the club head striking face 11, preferably past the midpoint and as far forward as possible without interfering with the striking characteristics of the club head 20 and thus providing a maximum range of possible lateral positions for the weight member or members 30. In the preferred embodiment for a putter, and especially for a blade putter as shown in the figures, the club head 10 is configured with a relatively large surface cavity 17 cut into the top surface 15 and/or rear wall 12. This structure removes unnecessary weight from the club head 10 and gives the club head 10 an inverted F-shape when taken in cross-section, as shown in FIG. 3.

Weight receiving cavity 20 provides space for the positioning of one or more weight members 30 within the club head 10 to alter the total weight and the balance of the club head 10. At least a portion of weight member 30 is obviously sized smaller than the dimensions of access opening 23 such that that portion can be inserted into the weight receiving cavity 20, and most preferably the entire weight member 30 is sized to fit completely within weight receiving cavity 20, thereby allowing the weight member 30 to be positioned at different locations laterally within the weight receiving cavity 20. Also preferably, weight members 30 are sized such that plural weight members 30 can be positioned within the weight receiving cavity 20. The weight member 30 comprises weight securing means 40 which is the means to releasably secure the weight member 30 at any position within weight receiving cavity 20. Securing means 40 is any suitable means to fix the weight member 30 at a particular location so that there is no relative movement between the weight member 30 and the club head 10 during use, which also allows the weight member 30 to be released and repositioned in or removed from the weight receiving cavity 20. Weight securing means 40 is preferably a mechanical mechanism, but could also be magnetic.

Figure 4:
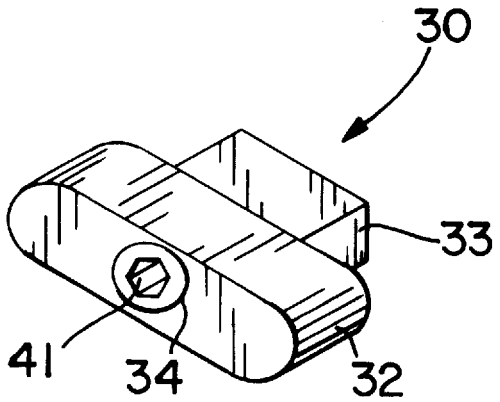
FIG. 4 is a perspective view showing a multi-part weight member.

The preferred embodiment for weight member 30 is shown in FIG. 4 and comprises a multi-part construction having a first or outer weight component 32 and a second or inner weight component 33. At least one and preferably both of outer weight component 32 and inner weight component 33 comprise a bevelled or angled contact wall 36. The inner and outer weight components 32 and 33 are positioned relative to each other such that the bevelled contact wall 36 of one of the weight components 32 or 33 contacts the other weight component 33 or 32, and preferably such that the two bevelled contact walls 36 abut each other. A smooth, non-threaded bore 34 passes through outer weight component 32 and is provided with a bolt head recess 39 of greater diameter than the interior portion of the smooth bore 34 to receive the head of a threaded bolt, rod or screw 41 so that it is flush with the outside of outer weight component 32. The diameter of the smooth bore 34 is in excess of the minimum diameter required to allow for insertion of threaded bolt 41. The inner weight component 33 contains a threaded bore sized as necessary for mating with the threaded bolt 41. The combination of threaded bore 35 and bolt head recess 39 causes the inner weight component 33 to be drawn against the outer weight component 32 when the threaded bolt 41 is tightened by turning. As the two weight components 32 and 33 are forced together, the bevelled contact surface 36 causes misalignment of the outer weight component 32, the oversize smooth bore 34 allowing the outer weight component 32 to tilt out of alignment with the axis of the threaded bolt 41, as shown in FIG. 3. Thus tightening the securing means 40 causes the weight member 30 to be wedged tightly between the upper surface 21 and lower surface 22 of the weight receiving cavity 20, and weight member 30 cannot be moved until the securing means 40 is released.

By forming the weight member 30 of two components 32 and 33, the total weight and weight distribution of the weight member 30 itself can be easily altered. For example, outer component 32 may be sized larger and heavier than inner component 33, as shown in FIG. 4. Alternatively, the weight components 32 and 33 can be made longitudinally longer or shorter and laterally thinner or thicker. This ability to alter the weight and weight distribution of each weight member 30, coupled with the ability to position multiple weight members 30 at any position within the weight receiving cavity, means that the club head 10 weight and balance (i.e., weight distribution) can be altered in an infinite number of combinations to suit the individual needs of the user. Furthermore, because the weight members are independently positioned, striking characteristics such as the size or location of the optimum striking point on the club head striking face 11 (i.e., the sweet spot) can also be altered to individual preference.

It is contemplated that equivalents and substitutions of elements described above may be obvious to those skilled in the art. The true scope and definition of the invention therefore is to be as set forth in the following claims.

We claim:

1. A golf club head having a striking face, a toe end, a heel end, a rear wall, a sole and a top surface, further comprising a generally horizontally disposed weight receiving cavity extending laterally through said club head from an access opening in said rear wall toward said striking face and extending longitudinally through said club head the majority of the distance between said toe end and said heel end, said weight receiving cavity having a generally parallel upper surface and lower surface, and further comprising at least one weight member fitting within said weight receiving cavity, and weight member securing means to releasably secure said at least one weight member at a fixed position contacting said upper and lower surfaces within said weight receiving cavity, where said at least one member is comprised of a first weight component and a second weight component connected to each other by said weight member securing means, and where said first weight component has a non-threaded bore and said second weight component has a threaded bore, and where at least one of said first and second weight components has a bevelled contact wall, and where said weight securing means comprises a threaded bolt member inserted through said non-threaded bore and said threaded bore, whereby tightening said threaded bolt member causes said at least one weight member to be wedged against said upper and lower surfaces of said weight receiving cavity.

2. The golf club head of claim 1, where said at least one weight member is positionable at different positions within said weight receiving cavity at any position both laterally in the direction from said striking face to said rear wall and longitudinally in the direction from said toe end to said heel end in order to alter the weight distribution of said golf club head.

3. A golf club head having a striking face, a toe end, a heel end, a rear wall, a sole and a top surface, further comprising a generally horizontally disposed weight receiving cavity extending laterally through said club head from an access opening in said rear wall toward said striking face and extending longitudinally through said club head the majority of the distance between said toe end and said heel end, and further comprising at least one weight member fitting within said weight receiving cavity, and weight member securing means to releasably secure said at least one weight member at different positions within said weight receiving cavity at any position laterally and longitudinally within said weight receiving cavity in order to alter the weight distribution of said golf club head.

4. The golf club head of claim 3, where said at least one member is comprised of a first weight component and a second weight component connected to abut each other by said weight member securing means.

5. The golf club head of claim 4, where said first weight component has a non-threaded bore and said second weight component has a threaded bore, and where at least one of said first and second weight components has a bevelled contact wall, and where said weight securing means comprises a threaded bolt member inserted through said non-threaded bore and said threaded bore, whereby tightening said threaded bolt member causes said at least one weight member to be wedged against said upper and lower surfaces of said weight receiving cavity.

6. The golf club head of claim 3, said weight receiving cavity having a generally parallel upper surface and lower surface, where said weight member securing means releasably secures said at least one weight member at a fixed position contacting only said upper and lower surfaces within said weight receiving cavity.

* * * * *